United States Patent [19]

Burke

[11] Patent Number: 4,658,337

[45] Date of Patent: Apr. 14, 1987

[54] PORTABLE FLUORESCENT LIGHTING DEVICE

[76] Inventor: Lawrence J. Burke, P.O. Box 306, Manhattan Beach, Calif. 90266

[21] Appl. No.: 803,014

[22] Filed: Nov. 29, 1985

[51] Int. Cl.[4] ..... F21S 3/00

[52] U.S. Cl. ..... 362/225; 362/219; 362/220; 362/249; 362/260

[58] Field of Search ..... 362/217, 219, 220, 225, 362/249, 263, 260, 804, 418, 427, 248

[56] References Cited

U.S. PATENT DOCUMENTS

| | | | |
|---|---|---|---|
| 2,956,149 | 10/1960 | Dowell et al. | 362/219 |
| 4,282,564 | 8/1981 | McJunkin, Jr. et al. | 362/225 |
| 4,564,886 | 1/1986 | Morcheles | 362/220 |

*Primary Examiner*—E. Rollins Cross
*Attorney, Agent, or Firm*—Edward A. Sokolski

[57] ABSTRACT

A portable fluorescent lighting device has a pair of elongated frame sections, each having a pair of oppositely positioned longitudinal bars which are joined together at their extreme ends by transverse cross bars. These two frame sections are pivotally joined together at one end. The other ends of each of the sections have removable transverse bars attached thereto to provide feet for the frame when the two sections are spread apart in a triangular configuration. A strap or chain interconnects the two sections to limit the triangular spread between these sections. Fluorescent lamps are mounted in one of the sections, these lamps being protected by the frames and having suitable transparent or transluscent cover guards.

6 Claims, 4 Drawing Figures

PORTABLE FLUORESCENT LIGHTING DEVICE

SPECIFICATION

This invention relates to portable lighting fixtures and more particularly to a work light which can be folded for transportation and installed at temporary work sites and the like.

Portable lighting fixtures are often needed for temporary illumination at construction sites, in motion picture studios, manufacturing plants, and situations where normal power can be interrupted, etc. Temporary lamps of the prior art have several shortcomings. Such lighting generally employs fluorescent lamps in view of the higher efficiency and low heat dissipation provided by this type of light source. Temporary lighting installations must be readily transportable and thus must be disassemblable or foldable so that they can readily be installed in and subsequently removed from their installation sites. At the same time, they must have rugged construction so that they can withstand the wear and tear incidental to the handling and usage involved. In addition, they must have stable supports so that they cannot readily be accidentally knocked over or otherwise displaced from their installed positions. Further, protection must be provided for the fluorescent lamps so that the hazard of their being accidentally broken is minimized.

The device of the present invention is a lighting fixture satisfying the aforementioned requirements and providing an improvement in this regard over portable lighting fixtures of the prior art. The device of the present invention affords the aforementioned improvements by utilizing a support frame employing a pair of similar elongated sections which are hingedly joined together at one end thereof. Each of these half sections includes a pair of spaced apart opposing longitudinal bar members which are joined at their ends by transverse bar members to form a rectangular frame section. A transverse foot member is attached to the free ends of each of the frame sections, these frame sections being spread apart in a triangular configuration to form a stand. The triangular spread between the two sections is limited by chains or straps attached between the stand sections. The fluorescent lamps are mounted in one or the other or both of the frame sections.

It is therefore an object of this invention to provide an improved portable lighting fixture which can readily be assembled and disassembled at an installation site.

It is a further object of this invention to provide an improved portable lighting fixture which is of durable construction and provides protection for fluorescent lamps installed therein.

It is still a further object of this invention to provide a portable lighting stand which while readily portable, provides stable support for the lamps installed therein.

Other objects of this invention will become apparent as the description proceeds in connection with the accompanying drawings of which, FIG. 1 is a perspective view of a preferred embodiment of the invention;

Figure 1:
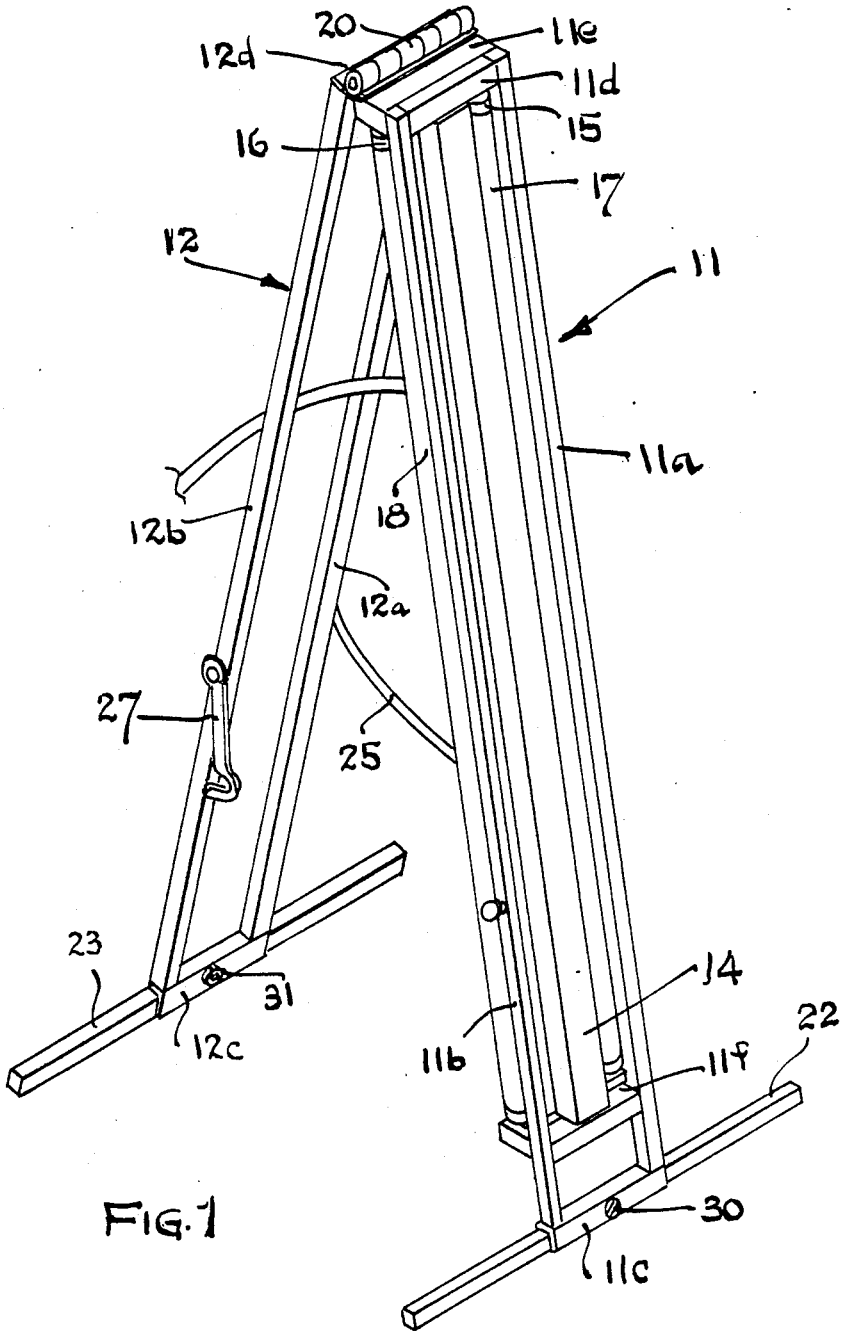
Figure 4:
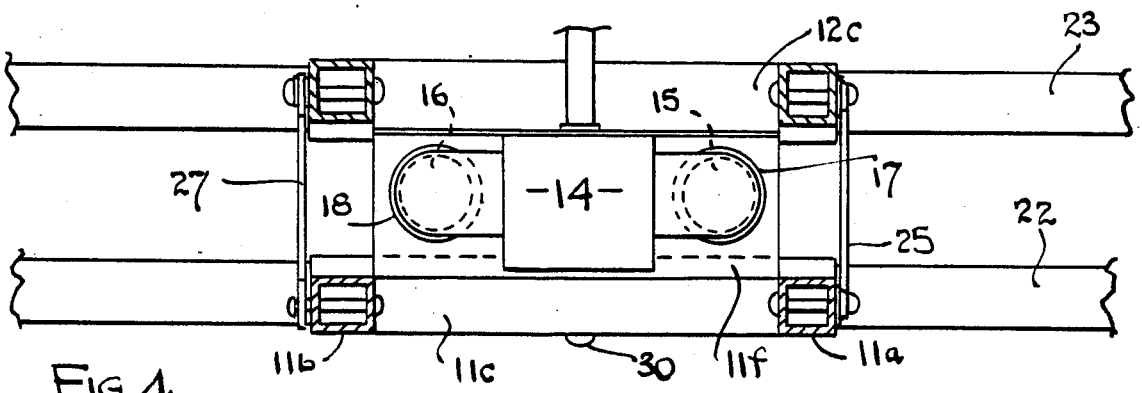
FIG. 4 is a cross-sectional view taken along the plane indicated by 4—4 in FIG. 3.
Figures 2, 3:
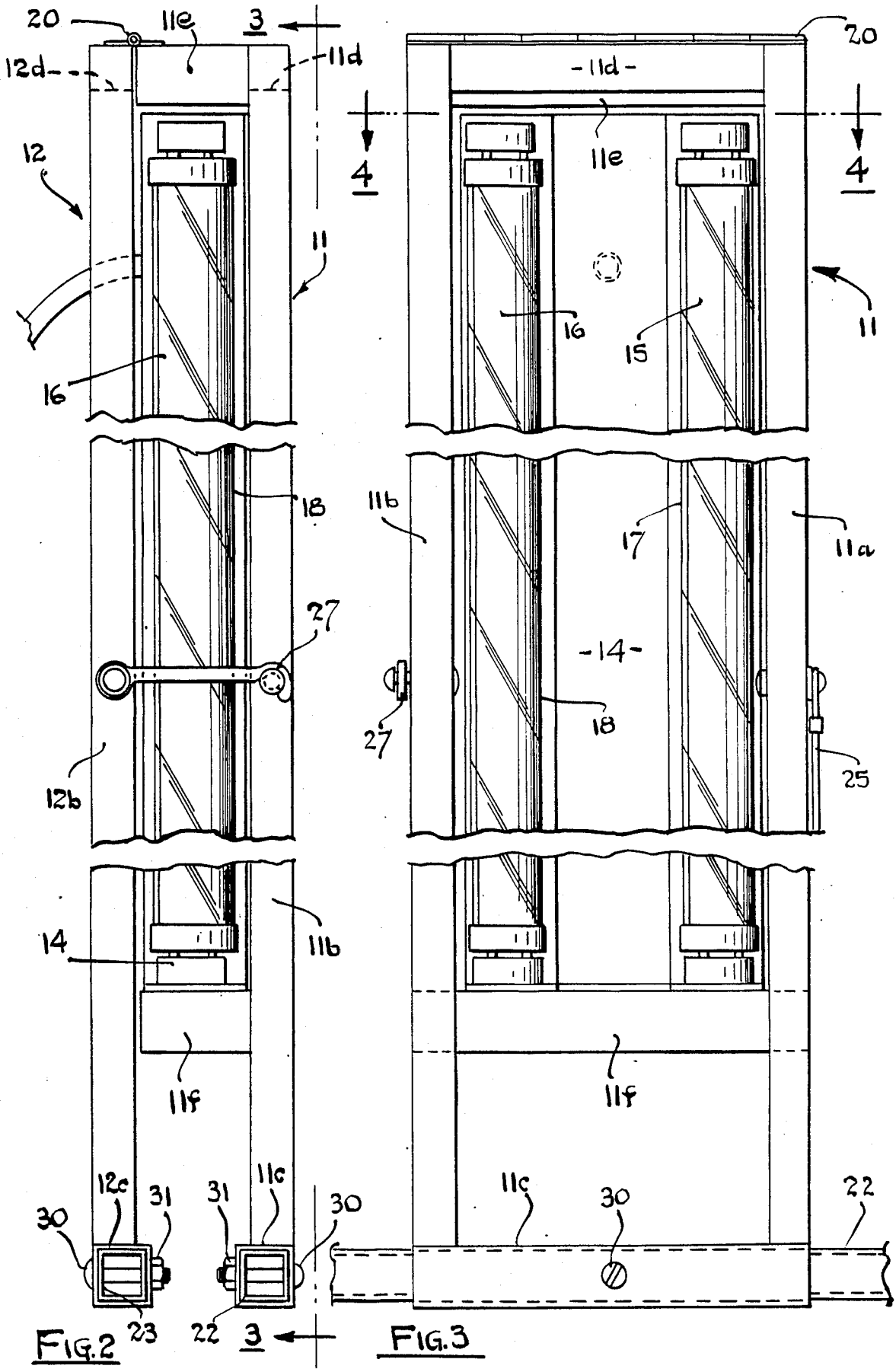
FIG. 2 is a end elevational view of the preferred embodiment in its folded position.
FIG. 3 is a view taken on a plane indicated by 3—3 in FIG. 2.

Referring now to the figures, a preferred embodiment of the device of the invention is illustrated. A pair of similar rectangular frame sections 11 and 12 are formed by spaced apart opposing bars 11*a*, 11*b* and 12*a*, 12*b*, which are joined together at their extreme ends by transverse bars 11*c*, 11*d* and 12*c*, 12*d*, respectively. End plates 11*e* and 11*f*, extend inwardly from frame 11, plate 11*e* being at the extreme end of the frame, while plate 11*f* is spaced upwardly along the frame from transverse bar 11*c*. Mounted between plates 11*e* and 11*f* is a conventional fluorescent lamp fixture 14 which has a pair of fluorescent lamps 15 and 16 installed therein. Surrounding each of lamps 15 and 16, is a transparent cover 17 and 18, respectively, which encloses the lamps and thus ameliorates the hazard from flying glass should the lamps be accidentally broken. The lamps are also protected by the frame sections 11 and 12. Sections 11 and 12 are hingedly joined together at one end by means of hinge member 20 which interconnects transverse frame section bar 12*d* and plate 11*e*. Transverse frame bars 11*c* and 12*c* are hollow, and telescopically fitted in each of these bars is a bar member 22 and 23 which form a pair of feet for the stand. For greater stability, the ends of the legs may be bent outwardly slightly. A chain or strap 25 is connected between frame sections 11 and 12 to limit the triangular spread between the sections. An attachment hook member 27 is provided to hold the two sections together when they are in the collapsed folded position for transportation. Foot members 22 and 23 are removably joined to transfers bar portions 11*c* and 12*c*, respectively, by means of bolts 30 and nuts 31.

While the invention has been described and illustrated in detail, it is to be clearly understood that this is intended by way of illustration and example only and is not to be taken by way of limitation, the spirit and scope of this invention being limited only by terms of the following claims.

I claim:

1. A portable lighting device comprising a pair of similar elongated frame sections, each of said frame sections including a pair of spaced apart longitudinal bar members joined together at the opposite ends thereof by transverse bar members to form a rectangular frame section, means for pivotably joining said frame sections together at one of the ends thereof, means for mounting at least one fluorescent lamp in one of said frame sections, means for removably interconnecting said frame sections at a point therealong spaced from said one of the ends thereof to limit triangular spread between the sections, and foot means attached to each of the frame sections at the other end thereof.

2. The lighting device of claim 1 wherein said foot means comprise bars, the transverse bar members at the other of the ends thereof being hollow, each of said bars being telescopically fitted in a respective one of said last mentioned transverse bar members and removably attached thereto.

3. The device of claim 1 wherein the means for pivotally joining said frame sections together comprises a hinge.

4. The device of claim 1 wherein there are a pair of fluorescent lamps mounted in said one of said sections, said lamps being positioned on the side of said one of said sections facing the other of said sections.

5. The device of claim 1 and further including means for holding said frame sections together in a folded configuration for transportation.

6. A portable lighting device comprising a pair of similar elongated rectangular frame sections, each of said frame sections including a pair of spaced apart longitudinal bar members joined together at the opposite ends thereof by transverse bar members, the transverse bar members at one of the ends of each of said frame sections being hollow, hinge means for pivotally joining said frame sections together at the other of the ends thereof, means for movably interconnecting said frame sections at a point therealong spaced from the other of the ends thereof to limit triangular spread between the sections, a bar telescopically fitted in each of the hollow transverse bar members and removably attached thereto, said bars forming feet for the frame sections, means for mounting at least a single fluorescent lamp on one of said frame sections, said lamp being mounted on the side of said one of said frame sections facing the other of said frame sections such that the lamp is between the frame sections and protected thereby, and means for holding said frame sections together in a folded configuration for transportation.

* * * * *